US005736004A

United States Patent [19]

Pangalos et al.

[11] Patent Number: 5,736,004

[45] Date of Patent: Apr. 7, 1998

[54] CONTROL SCHEME FOR RAPID PULP DELIGNIFICATION AND BLEACHING

[75] Inventors: George Pangalos, Plainsboro, N.J.; Ronald A. Falcone, Jr.; William L. Mayo, both of Chesapeake, Va.; Gregory J. Bosch, Yardville, N.J.

[73] Assignee: Union Camp Patent Holding, Inc., Wayne, N.J.

[21] Appl. No.: 789,493

[22] Filed: Jan. 27, 1997

Related U.S. Application Data

[63] Continuation-in-part of Ser. No. 399,717, Mar. 3, 1995, Pat. No. 5,672,247.

[51] Int. Cl.[6] ..... D21C 7/12

[52] U.S. Cl. ..... 162/49; 162/198; 162/238

[58] Field of Search ..... 162/49, 62, 65–67, 162/238, 198, DIG. 10

[56] References Cited

U.S. PATENT DOCUMENTS

| | | | |
|---|---|---|---|
| 3,607,623 | 9/1971 | Chappelle | 162/252 |
| 3,617,717 | 11/1971 | Smith | 364/137 |
| 3,650,890 | 3/1972 | Kamio | 162/49 |
| 3,729,375 | 4/1973 | Chappelle | 162/252 |
| 3,962,029 | 6/1976 | Wettermark et al. | 162/49 |
| 3,968,006 | 7/1976 | Zimmerman | 162/198 |
| 3,980,517 | 9/1976 | MacTaggart | 162/49 |
| 4,013,506 | 3/1977 | Histed et al. | 162/49 |
| 4,155,806 | 5/1979 | Mannbro | 162/19 |
| 4,198,266 | 4/1980 | Kirk et al. | 162/29 |
| 4,248,662 | 2/1981 | Wallick | 162/19 |
| 4,278,496 | 7/1981 | Fritzvold | 162/19 |
| 4,279,694 | 7/1981 | Fritzvold et al. | 162/28 |
| 4,348,256 | 9/1982 | Bergstrom et al. | 162/49 |
| 4,372,812 | 2/1983 | Phillips et al. | 162/40 |
| 4,384,920 | 5/1983 | Markham et al. | 162/19 |
| 4,431,480 | 2/1984 | Markham et al. | 162/19 |
| 4,459,174 | 7/1984 | Papageorges et al. | 162/40 |
| 4,595,455 | 6/1986 | Mannbro | 162/38 |
| 4,619,733 | 10/1986 | Kooi | 162/30.1 |
| 4,840,703 | 6/1989 | Malmsten | 162/49 |
| 4,978,425 | 12/1990 | Beller et al. | 162/49 |
| 5,173,153 | 12/1992 | Terrett et al. | 162/40 |
| 5,174,861 | 12/1992 | White et al. | 162/57 |
| 5,181,989 | 1/1993 | White et al. | 162/241 |
| 5,403,441 | 4/1995 | McDonald | 162/65 |

FOREIGN PATENT DOCUMENTS

| | | | |
|---|---|---|---|
| 999950 | 11/1976 | Canada . | |
| 1132760 | 10/1982 | Canada . | |
| 1154205 | 9/1983 | Canada . | |
| 2067844 | 11/1992 | Canada . | |
| 0 047 656 A1 | 3/1982 | European Pat. Off. . | |
| 162258 | 5/1972 | New Zealand . | |
| 162119 | 7/1972 | New Zealand . | |
| 158 591 | 11/1972 | New Zealand . | |
| 158591 | 11/1972 | New Zealand . | |
| 167756 | 4/1974 | New Zealand . | |
| 169558 | 4/1974 | New Zealand . | |
| 175 906 | 7/1977 | New Zealand . | |
| 175906 | 7/1977 | New Zealand . | |
| 194 036 | 11/1983 | New Zealand . | |
| 194036 | 11/1983 | New Zealand . | |
| 232 530 | 7/1992 | New Zealand . | |
| 232530 | 7/1992 | New Zealand . | |
| WO 91/18145 | 11/1991 | WIPO . | |
| WO 94/15018 | 7/1994 | WIPO . | |
| WO 94/23123 | 10/1994 | WIPO . | |
| WO 94/29512 | 12/1994 | WIPO | 162/65 B |

OTHER PUBLICATIONS

Kappel et al. "High–contsistency ozone–bleaching technology". Tappi Journal. 1994. vol. 77. No. 6. pp. 109–116.

Patt et al. "Use of Ozone for Pulp Bleaching." 42(10A): V14–23 (Oct. 1988).

Seymour et al. "Testing and Control in Bleach Plants." Bleaching of Pulp. TAPPI. 3rd Edition. p. 478. 1979.

M. Ollila. "Chemical Pulp Bleaching Control Based on Inline Brightness and Residual Measurements Before and After Stage." TAPPI Proceedings. 1988 Pulping Conference. pp. 603–608. 1988.

White et al., "Importance of Reactor Design in High Consistency Ozone Bleach." Pulp & Paper Canada. vol. 94. No. 9. pp. 242–247 (1993).

R.P. Singh. "Ozone Replaces Chlorine in the First Bleaching Stage." TAPPI. vol. 64. No. 2. pp. 45–48 (Feb. 1982).

U. Germgard et al.. "Ozone Prebleaching of a Modified–Cooked and Oxygen–Bleached Softwood Kraft Pulp." Svensk Papperstidning. No. 15. 1985. pp. 127–132.

Liebergott et al.. "$O_2$. $O_3$ and Peroxide". *Seminar Notes, 1978, Pulping and Bleaching Seminar*, pp. 90–105.

Singh. "Computer Control". *The Bleaching of Pulp*, TAPPI Press. 1979. pp. 503–513.

Burnett. "Computer Control of the Chlorine Stage". *Pulp and Paper Magazine of Canada*, vol. 71. No. 14. Jul. 17. 1970. pp. 57–62.

K.H. Ferguson. "Union Camp Begins Ozone Era with New Kraft Bleaching Line at Franklin. Va.." Nov. 1992. pp. 42–55. *Pulp & Paper*.

F.G. Shinskey. *Process Control Systems—Application, Design, and Tuning*, Third Edition. pp. 4–7. 10–11. 14–15. 18–19. 42–43. 120–121. 1988. McGraw–Hill.

A.G. Jamieson et al.. "Washing System." May 1973. pp. 187–191. *Svensk Papperstidning*.

B.S. Kirk et al.. "Low–Consistency Oxygen Delignification in a Pipeline Reactor." 1978. pp. 77–80. *Tappi*, vol. 61. No. 5.

(List continued on next page.)

*Primary Examiner*—Donald E. Czaja
*Assistant Examiner*—Steven B. Leavitt
*Attorney, Agent, or Firm*—Gary M. Nath; Suet M. Chong; Nath & Associates

[57] ABSTRACT

A process control method for adjusting chemical application in response to the pulp brightness and/or lignin content is realized by utilizing a coupled control feedforward. feedback or combination feedforward/feedback control system. wherein brightness measurements are made between successive lignin content measurements and adjustments made to the chemical application in response to a comparison value.

36 Claims, 7 Drawing Sheets

OTHER PUBLICATIONS

H.deV. Partridge, "Pulp & Paper Technology: New Pulp Bleaching Developments," pp. 45–50, Jun. 1976, *CEP*.

J.K. Perkins et al., "Advances in Ozone Bleaching—Part III," pp. 263–266.

G.A. Smook, *Handbook for Pulp and Paper Technologists*, pp. 154–172, TAPPI.

John S. Fujii et al., "Oxygen Pulping of Hardwoods," pp. 1–12.

G.A. Smook, *Handbook of Pulp & Paper Technologists*, Joint Executive Committee of the Vocational Education Committees of the Pulp and Paper Industry, pp. 160–164 (1982).

Soai et al., "Catalytic Asymmetric Induction Highly Enationselective Addition of Dialkylzincs to Aldehydes Using Chiral Pyrrolidinylmethanols and Their Metal Salts", *J. Am. Chem. Soc.*, vol. 109, pp. 7111–7115 (1987).

CONTROL SCHEME FOR RAPID PULP DELIGNIFICATION AND BLEACHING

This application is a continuation-in-part of U.S. patent application Ser. No. 08/399,717, filed Mar. 3, 1995, U.S. Pat. No. 5,672,247, the entire contents of which are incorporated herein by reference.

BACKGROUND OF THE INVENTION

1. Field of the Invention

The present invention relates to a coupled control method for controlling a chemical pulping process to a desired degree of delignification or bleaching.

2. Description of the Prior Art

Wood is comprised of two main components—a fibrous carbohydrate, i.e., cellulosic portion, and a non-fibrous component. The polymeric chains forming the fibrous cellulose portion of the wood are aligned with one another and form strong associated bonds with adjacent chains. The non-fibrous portion comprises a three-dimensional polymeric material known as lignin. Part of the lignin is between the cellulosic fibers, bonding them into a solid mass, although a substantial portion of the lignin is also distributed within the fibers themselves. Lignin is the material in paper pulp which causes its brown appearance and which must be removed to produce white paper.

For use in paper-making processes, wood must first be reduced to pulp. Pulp may be defined as wood fibers capable of being slurried or suspended and then deposited upon a screen to form a sheet, i.e., of paper. Pulping of the wood by the well known kraft or modified kraft pulping processes results in the formation of a dark colored slurry of cellulose fibers known as "brownstock". See, for example, Rydholm, *Pulping Processes*, Interscience Publishers, 1965 and TAPPI Monograph No. 27, *The Bleaching of Pulp*, Rapson, Ed., The Technical Association of Pulp and Paper Industry (1963).

The dark color of the brownstock is attributable to the fact that not all of the lignin is removed during digestion and becomes chemically modified during pulping to form chromophoric groups. Thus, to lighten the color of the brownstock pulp, it is necessary to continue to remove the remaining lignin by the addition of delignifying materials and by chemically converting any residual lignin into colorless compounds by a process known as "bleaching" or "brightening".

Further, delignification and bleaching processes are conducted on washed pulp in a series of steps using selected combinations of chemical reactants. In the prior art, various combinations of chemical treatments have been suggested, such as with the use of elemental chlorine, chlorine dioxide, ozone, oxygen, hypochlorite, hydrogen peroxide and alkali. Each of these chemical treatments, however, has various disadvantages. Chlorine has a negative environmental impact. Hypochlorite is known to reduce pulp strength and also causes environmental concerns. Excessive application of the remaining agents can cause degradation of the pulp integrity or strength.

Chlorine dioxide has less of an environmental impact than elemental chlorine. Nevertheless, inefficient use of the chemical will result in under-bleached pulp if too little is applied and weakened pulp if excess is applied. This excess also increases the negative environmental impact due to the production of organo-chlorine compounds. Therefore, proper control is desirable. When chlorine dioxide is used in reaction sequences where it is contacted with pulp for a short time, such as in WO 94/15018, a significant part of the reaction occurs in a short period of time requiring a rapid responding control scheme. For this discussion, "a significant part of the reaction" refers to consuming about 25% or more of the available chemical reactant and a "short time" refers to about 5 minutes or less, preferably less than about 2 minutes and most preferably about 0.1 second to 100 seconds.

To avoid the use of chlorine containing agents, the use of ozone has been proposed. Advantageously, ozone will readily react with lignin to effectively reduce the amount of lignin in the pulp. Under many conditions, it will, however, deleteriously attack the carbohydrate which comprises the cellulosic fibers of the wood to substantially reduce the strength of the resultant pulp. Ozone, moreover, is extremely sensitive to process conditions with respect to its oxidative and chemical stability, and such changes can significantly alter the reactivity of the ozone with respect to the lignocellulosic materials.

Since the delignifying capabilities of ozone were first recognized around the turn of the century, there has been substantial and continuous work in the field to develop a commercially suitable method using ozone in the bleaching of lignocellulosic materials. Such a method has proven to be difficult for several reasons, one being the fast speed within which the bleaching process is completed.

A novel apparatus and method for bleaching pulp with ozone in a commercially feasible manner to produce a high grade bleached pulp is disclosed in U.S. Pat. No. 5,181,989 granted Jan. 26, 1993, entitled "Pulp Bleaching Method," and U.S. Pat. No. 5,174,861 granted Dec. 29, 1992, entitled "Method of Bleaching High Consistency Pulp With Ozone". Under defined parameters, a gaseous ozone bleaching agent is used to provide a highly selective removal and bleaching of the lignin with minimal degradation of cellulose. Process parameters that must be controlled include pulp feed rate, pulp particle or agglomerate size, pulp consistency, pulppH, pulp temperature, degree of pulp delignification, ozone feed concentration, ozone feed rate, ozone application to pulp which is a function of ozone concentration and gas flow rate, and the residence time of both the gas and the pulp in the ozone reactor. Within the reactor vessel, the pulp is advanced in a dispersed plug flow manner that subjects substantially all of the pulp particles or agglomerates to the ozone in a continuous and uniform fashion to obtain a substantially uniformly increased brightness pulp.

While the above-mentioned apparatus is advantageous in that chlorinated materials may be avoided in the bleaching process so that virtually all the liquid filtrates can be recycled and recovered, it would be further desirable to improve the control of the degree of bleaching across the reactor to achieve a more consistent pulp quality after ozonation, as measured by such parameters as pulp brightness or Kappa number. Kappa number is a measure of the quantity of lignin in the pulp and represents a real chemical measurement. In addition, it is important to rapidly achieve a new steady state, for example, following a planned change in production rate or target brightness. Moreover, due to the relatively short residence time of the pulp with the ozone in a continuous reactor, there is a need to rapidly adjust the ozone application to minimize under- or over- bleaching and achieve target brightness with optimum ozone consumption.

From all of the above, control of the application of ozone, as well as other chemicals for treating pulp, will optimize delignification and bleaching, while minimizing pulp degradiation and waste. The prior art does not provide effective control schemes for fast reacting chemical treatments, such as high and medium consistency ozone, chlorine dioxide and hydrogen peroxide treatments.

In an attempt to overcome some of the prior art deficiencies encountered, several control methods have been proposed. Canadian Patent No. 999,950 provides a feedforward type control method which is designed to maximize dynamic effectiveness by compensating for the inherent time delay between chlorine addition and sensor position, and for the variations in chlorination temperature and retention time in a premixer and reactor means. The method includes the steps of sensing a color value related to a Kappa number of pulp after the pulp has been subjected to a bleaching agent; providing a prediction model which, in response to said sensed value, the amount of bleaching agent added, and the temperature and retention time in the premixer and reactor means, predicts the future value of the Kappa number, after being withdrawn from said means, relative to the present amount of bleaching agent being added; and then comparing the predicted future value after being withdrawn from the reactor with a set point reference and changing the amount of bleaching agent in response to a lack of comparison.

By contrast, M. Ollila, "Chemical Pulp Bleaching Control Based on In-Line Brightness and Residual Measurements Before and After Stage", TAPPI 1988 Pulping Conference, New Orleans, USA, 30 Oct.—2 Nov. 1988, Vol. 3, pp. 603–608 (Atlanta, USA: TAPPI Press, 1988), discloses a dual sensor control method using brightness and residual measurements. The method provides for control of the chemical dosage level, compensates for the effects of sudden process changes (such as variation in pulp Kappa number before chemical application, production rate, temperature, chemical consistency and carryover) and helps to achieve a stable Kappa number after the extraction stage (E-stage). Ollila also discloses dual sensor control equipment with long feedback control that combines short delay brightness and residual measurements with after tower brightness and residual measurements.

SUMMARY OF TEE INVENTION

It is the nature of the measurement of pulp properties, such that those properties which are true measures of lignin content require longer times to conduct. Generally, with current technology, it takes at least about five minutes to measure such properties as Kappa number, K number, Klason lignin and the like.

Pulp properties which can be measured quickly or continuously on-line, such as brightness, are inconsistent because of fluctuations in the measurement due to many variables such as fiber type, pH, consistency, temperature and the like, which affect the measurement but do not reflect changes in lignin content. Although these fluctuations are generally modest over short periods of time such as, for example, up to 30 minutes of pulp processing in a bleach plant, they can be much greater over longer periods. Previous attempts relying on brightness alone to control fast, short term bleaching processes have failed for this reason.

The present invention overcomes this deficiency by correlating a rapid or continuous measure of pulp property, such as brightness, with a true measure of pulp property, such as Kappa number, K number, Klason lignin or similar measure of lignin content. It is this correlation, when applied to control the application of chemical to pulp, that is termed "coupled control".

In a production mill setting, the correlation is performed on-line. During the period between successive lignin content measurements, the secondary pulp property measurement, such as brightness, is re-correlated or calibrated periodically with a true measure of lignin content, such as Kappa number, K number, Klason lignin or the like, to control the application of chemical to pulp.

This technique can be utilized in feedforward, feedback and combination feedforward/feedback control schemes.

The present method involves a coupled control method for controlling pulp delignification or bleaching using a feedforward, feedback or combination feedforward/feedback measurement. More particularly, the method involves the use of rapidly obtained brightness measurements to modify the amount of chemical application between successive lignin content measurements. Chemical charge is established through aggressive feedforward action based on lignin content measurements taken at locations before the point of chemical application to pulp, and soft feedback action based on lignin content measurements taken at locations after the point of chemical application to pulp.

Specifically, the feedforward control adjusts the amount of chemical based on on-line measurements of characteristic properties of pulp at locations before the point of chemical application, amounts of pulp at locations before the point of chemical application, and concentration of chemical. More particularly, using a predictive equation based on the operating characteristics of the reactor, the chemical application required to achieve a desired characteristic pulp property, or degree of delignification or bleaching, is calculated and the amount of chemical adjusted accordingly at locations before the point of application. Sensors, in a feedback loop configuration with the reactor, monitor the pulp property at locations after the point of chemical application.

Because of the relatively short gas and pulp residence times in some reactors, and high sensitivity to operating parameters, the pulp property after chemical application responds rapidly to changes in the pulp property before chemical application, the production rate, and/or other operating conditions. Advantageously, the present invention affords a method for controlling the amount of chemical application to the pulp to most rapidly achieve a desired degree of delignification or bleaching, despite such varying operating conditions.

In a preferred embodiment, the present invention involves a method for controlling a chemical pulping process to obtain a desired degree of delignification or bleaching, which comprises the steps of adding at least one chemical at a desired amount to the pulp, passing the pulp into and out of a reactor, measuring the brightness value of the pulp between successive lignin content measurements, and adjusting the quantity of the at least one chemical in response to the measured brightness and lignin content values.

A particularly preferred procedure for adjusting the quantity of the at least one chemical involves periodically measuring the lignin content of the pulp at locations before the point of application of the at least one chemical (or before the point of application of the final chemical where two or more chemicals are applied) and adjusting the amount of the at least one chemical to obtain the desired degree of delignification or bleaching; measuring the pulp brightness between the periodic lignin content measurements, and, optionally, making an average of several pulp brightness measurements; comparing the brightness measurement or the average brightness measurement with the brightness representing the lignin content for that period prior to the next lignin content measurement to initiate an adjustment in the quantity of the at least one chemical; and adjusting the quantity of the at least one chemical in response to the comparison value.

Another preferred procedure involves the use of a predictive equation to calculate the chemical application required to achieve a desired degree of delignification or bleaching.

There are various methods for utilizing the feedforward, feedback or combination feedforward/feedback control. In one embodiment, during startup and under feedforward control, a chemical application is base loaded to a reactor. Once having reached a steady state operation, the chemical application is adjusted solely under the coupled control method.

BRIEF DESCRIPTION OF THE DRAWINGS

A more complete understanding of the invention may be obtained from the following description of the appended drawings.

DETAILED DESCRIPTION OF THE INVENTION

Figure 1:
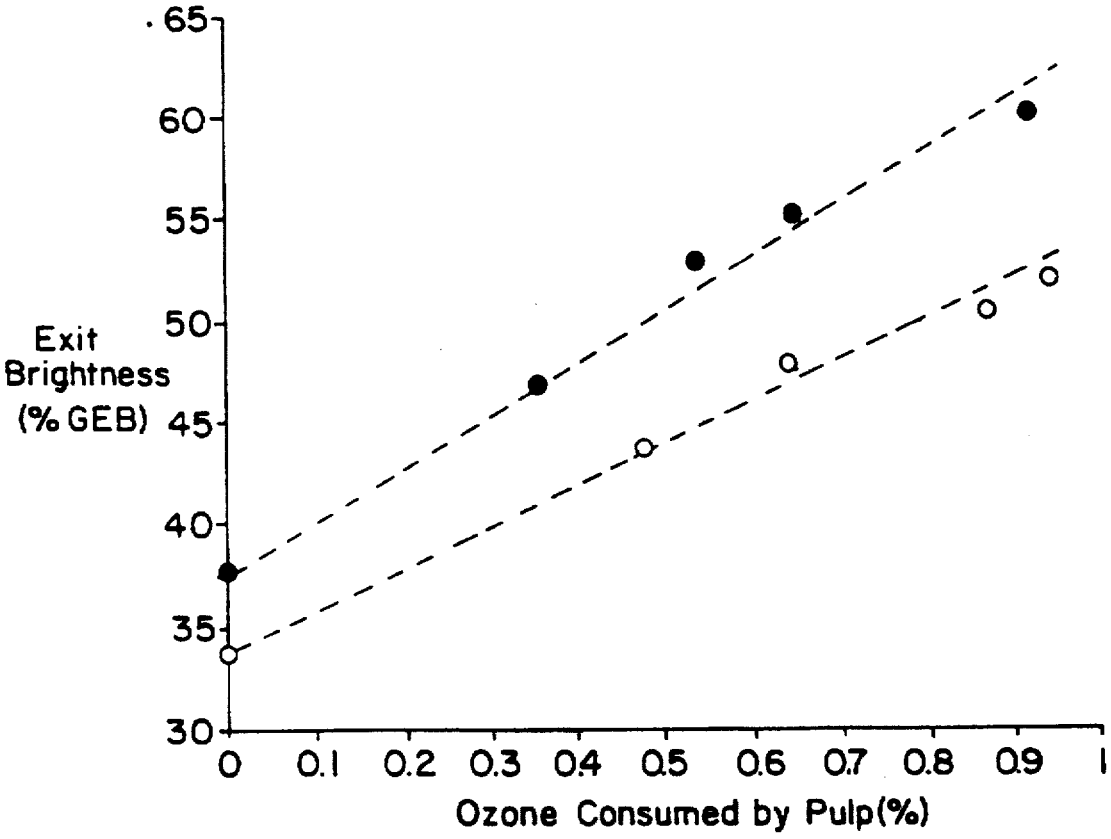
FIG. 1 is a graph of the pulp brightness after chemical application, versus the ozone consumption (%) for two different brightness levels of the pulp before chemical application.

The present invention relates to a method for controlling a chemical pulping process to obtain a desired degree of delignification or bleaching, while minimizing the amount of chemical required.

The method may be used to control any chemical pulping process, but is particularly effective in delignification or bleaching processes, or stages of such processes, which are characterized by a fast, short term chemical reaction. Examples of applicable stages of processes include O-stage (oxygen), C-stage (chlorine), D-stage (chlorine dioxide with or without chlorine), P-stage (hydrogen peroxide), Z-stage (ozone), and extraction stages (E, Ep, Eo, Eop, etc.).

The method comprises the steps of adding at least one chemical at a desired amount to pulp; passing the pulp into and out of a reactor; measuring the brightness value of the pulp between successive lignin content measurements; and adjusting the quantity of the at least one chemical required to reach a desired degree of delignification or bleaching in response to the measured brightness and lignin content values.

The chemical pulping process that is controlled by the present method may be continuous, batch, semibatch or a combination thereof.

The lignin content measurement, as well as subsequent references to $K_{Before}$ and $K_{After}$, represents any true measure of pulp lignin content, including without limitation permanganate number (also known as K number), Kappa number and Klason lignin number.

The at least one chemical used in the present method may be any bleaching agent, delignifying agent or other pulping additive, such as, for example, an oxidant, caustic, chelating agent, oxidant stabilizer, catalyst, or a combination thereof.

The oxidant is preferably selected from the group consisting of hydrogen peroxide, oxygen, ozone, chlorine, chlorine dioxide, peracetic acid, persulfuric acid, and a combination thereof. The oxidant can be prepared fresh or recycled from a prior cycle of pulp bleaching.

The caustic is preferably a base, a basic salt, or a combination thereof. The caustic can be added in any suitable form on its own or in combination with a chelating agent. Particularly preferred bases are sodium hydroxide and potassium hydroxide. Particularly preferred basic salts are carbonate salts. The caustic is applied at a charge of from about 0.05% to about 7% by weight of oven dry pulp.

The chelating agent is preferably an aminopolycarboxylic acid, a substituted diglycolic acid, a geminal diphosphonic acid, sodium silicate, a derivative thereof, or a combination thereof. More preferably, the chelating agent is selected from the group consisting of diethylenetriaminepentaacetic acid (DTPA), ethylenediaminetetraacetic acid (EDTA), nitrilotriacetic acid (NTA), methanediphosphonic acid (MDPA), tetrahydrofurantetracarboxylic acid (THFTCA), (1-hydroxyethylidene) diphosphonic acid (HEDPA), sodium silicate, a derivative thereof, and a combination thereof. The chelating agent is added to the pulp at a charge of from about 0.01% to about 5% by weight of oven dried pulp.

The oxidant stabilizer is preferably magnesium sulfate, sodium silicate or a combination thereof. A particularly preferred oxidant stabilizer is magnesium sulfate. Prepared fresh or recycled from a prior cycle of pulp bleaching, the oxidant stabilizer can be added either before, after or simultaneously with the addition of a caustic, an oxidant or a combination thereof.

The catalyst is preferably a metal-based activator containing at least one metal selected from the group consisting of chromium, vanadium, molybdenum, titanium, tungsten, tin, osmium and selenium. Organic or inorganic in nature, the activator can be used by itself or as part of a complex. Such a complex preferably comprises the activator in combination with a chelating agent.

The reactor, as used in the present method, includes any mechanical part or parts of a pulp delignification or bleaching system. For example, the reactor may be a tube, a mixer, a vessel, a pipe, or a portion or a combination thereof.

In a preferred embodiment, the quantity of the at least one chemical is adjusted by periodically measuring the lignin content of the pulp at locations before the point of application of the at least one chemical, and then adjusting the amount of the at least one chemical to obtain the desired degree of delignification or bleaching; measuring the pulp brightness between periodic lignin content measurements and, optionally, making an average of several pulp brightness measurements; comparing the brightness measurement or the average brightness measurement with the brightness representing the lignin content for that period prior to the next lignin content measurement to initiate an adjustment in the quantity of the at least one chemical in response to the comparison value.

An average, as applied to the present method, may represent an arithmetic mean or a moving average. The arithmetic mean is the result obtained by dividing the sum total of a set of measurements by the number of measurements. The moving average is the arithmetic mean of a specified number of consecutively taken measurements, the earliest of which drops out as a new measurement is taken in the progression of the chemical pulping process.

As a convenience in understanding the improvements of the present invention over the prior art, the following process parameters as used throughout this specification are defined below.

The "degree of delignification" is normally used in connection with the pulping process and the early bleaching stages. It tends to be less precise when only small amounts of lignin are present in the pulp, i.e., in the later bleaching stages.

The "brightness" factor is normally used in connection with the bleaching process because it tends to be more precise when the pulp is lightly colored and its reflectivity is high.

There are many methods of measuring the degree of delignification, but most are variations of the permanganate test. Permanganate tests provide a permanganate number ("K number") and/or a Kappa number which are related to the number of cubic centimeters of one-tenth normal potassium permanganate solution consumed by a known amount of oven dried pulp under specified conditions. The Kappa number is determined by TAPPI Standard Test T-236, while the K number is described in the TAPPI Useful Method UM-226 and the TAPPI Useful Method UM-229.

There are also a number of methods of measuring pulp brightness. This parameter is usually a measure of reflectivity and its value is expressed as a percent of some scale. A standard measurement is the General Electric Brightness (GEB) which is a measurement of directional reflectance and is expressed as a percentage of a maximum GEB value. GEB is be obtained by following TAPPI Standard Method T-452.

The present method affords control of a pulp property at locations before and/or after the point of chemical application, with variability in one or more process parameters. The present method is preferably used to control an ozone bleaching reactor, although it may be applied to other types of reactors employing different chemicals.

Advantageously, bleaching under properly defined conditions minimizes the degree of attack upon the cellulosic portion of the wood, thereby forming a product having acceptable strength and brightness properties for the manufacture of papers and various paper products.

Although the present coupled control method is suitable for use in various pulp delignification and bleaching systems, it is particularly effective when used in combination with the ozone bleaching reactor disclosed in U.S. Pat. Nos. 5,181,989 and 5,174,861 and the corresponding ozone bleaching processes disclosed in U.S. Pat. Nos. 5,164,043 and 5,164,044, all of which patents are incorporated herein by reference.

Specifically, it has been found that the ozone reactor disclosed in U.S. Pat. No. 5,181,989 operates substantially in a plug flow type manner. In an ideal plug flow reactor, all of the material flowing through the reactor has the same residence time, i.e., it spends substantially the same amount of time in the reactor before emerging at the other end. Accordingly, a reference to "plug flow" is to be understood to mean that the residence time distribution of the pulp particles or agglomerates with the gaseous bleaching agent is as narrow as possible such that most of the pulp particles or agglomerates spend substantially the same amount of time in the reactor.

The present control method comprises various measuring steps and corrective algorithms, including, but not limited to, the following:

(1) specifying a target pulp property at a location after the point of application of at least one chemical to pulp, such as a desired or an expected lignin content value (target $K_{After}$) or brightness value (target $GEB_{After}$);

(2) measuring on-line the lignin content of the pulp at a location before the point of application of the at least one chemical ($K_{Before}$), in a manner well-known in the art;

(3) specifying a target lignin content of the pulp at a location before the point of application of the at least one chemical (target $K_{Before}$);

(4) measuring an operating parameter of the reactor, such as the pH, temperature, flow rate or consistency of the pulp at locations before the point of application of the at least one chemical (or before the point of application of the final chemical where two or more chemicals are applied), the flow rate or concentration of the at least one chemical, the residence time of the pulp in the reactor, the pressure, the efficiency of mixing, the residual chemical, or a combination thereof, as required;

(5) measuring on-line the brightness value of pulp between successive lignin content measurements;

(6) under feedforward control (predictive control), calculating and adjusting the chemical application needed to achieve a desired degree of delignification or bleaching for the current operating parameters of the reactor; and (7) under feedback control, further adjusting the chemical application to achieve the desired degree of delignification or bleaching, as defined by a target lignin content or a target brightness value.

A controlling factor for chemical pulping is the relative amount of chemical used to delignify or bleach a given amount of the pulp. This amount is determined, at least in part, by the amount of lignin which is to be removed during the chemical pulping process, balanced against the relative amount of degradation of the cellulose that can be tolerated during delignification or bleaching.

There are many control problems involved in chemical pulping, not the least of which is a wide variation in the wood source. Trees grown in different locations; even though they are exactly the same species, may have highly different qualities. This wide variation in wood quality results in chemical pulping processes whereby the resulting pulp whiteness is inconsistent. Other control difficulties arise because of the differences in concentrations of applied chemicals, fluctuations in pulp consistency, differences in the pulp lignin content before chemical application and unforeseen changes that occur within the chemical pulping process.

The amount of lignin to be removed during chemical pulping is another important factor in controlling the chemical pulping process. This amount of lignin is related to the degree of brightening desired across the process, i.e., the difference between the pulp brightness levels before and after chemical application.

FIG. 1 graphically shows the brightness of pulp after ozone application (specifically, after exiting the ozone reactor) as a function of ozone consumption. The GEB measurements presented in FIG. 1 are standardized laboratory values where most of the conditions affecting the measurement values, such as pH and temperature, are fixed. The data shown in FIG. 1 were laboratory ozone bleaching data on pine pulp taken at two different levels of pulp brightness before ozone application (specifically, before entering the ozone reactor): 35% GEB and 37.5% GEB as indicated by the solid and open circles, respectively. As shown in FIG. 1, there is a clear relationship between the pulp brightness after exiting the ozone bleaching stage and the ozone consumption in the ozone stage. Also, there is a clear relationship between the pulp brightness before ozone application and how much ozone consumption is required in the ozone stage to achieve a specific pulp brightness after ozone application. Furthermore, there is a well known relationship between standardized pulp brightness and lignin content of pulp, such that the more lignin removed the brighter the pulp appears. It follows from these trends that the feedback and feedforward control according to the present invention can be applied effectively in the bleaching of pulp with ozone.

The amount of chemical, particularly oxidant, used in the pulping process has an asymptotic effect on the degree of delignification. As such, delignification improves with increasing amounts of chemical up to a certain point, beyond which delignification levels off despite increasing amounts of chemical. Generally, any reasonable amount of chemical which produces an acceptable level of delignification and cellulose degradation, as determined by those skilled in the art, can be used.

Preferably, the initial amount of oxidant charged to the pulp in the oxidation stage is from about 0.01% to about 6% by weight of oven dry pulp. More preferably, the charge of oxidant in the pulp is between about 0.2% and about 4%. Most preferably, the charge of oxidant in the pulp is between about 0.5% and about 3%.

Where the oxidant is ozone gas, it may be employed as a mixture of ozone with oxygen and/or an inert gas, or as a mixture of ozone with air. The amount of ozone which can satisfactorily be incorporated into the treatment gases is limited by the capability of the ozone generation units to economically generate ozone, as well as by the stability of the ozone in the gas mixture. Ozone gas mixtures which typically, but not necessarily, contain about 1–14% by weight of ozone/oxygen mixture, are suitable for use in the pulping process. A higher concentration of ozone in the ozone/oxygen mixture allows for the use of relatively smaller size reactors, and a shorter reaction time to treat equivalent amounts of pulp.

The reaction temperature at which the chemical pulping process is conducted is likewise a controlling factor in the optimal delignification or bleaching of the pulp. The chemical pulping process can be effectively conducted at temperatures up to a certain level. Above this level, the chemical reaction starts to cause excessive degradation of the cellulose and increased chemical requirement to reach a target pulp property, due to factors such as increased chemical decomposition at higher temperatures. For example, the reaction temperature of ozonation of southern U.S. pine is preferably below 150° F.

The pulp pH may also significantly affect the delignification of lignocellulosic materials during the chemical pulping process. The optimal level of pulp pH, as determined with respect to enhancing selectivity of the pulping process, varies with the chemical or chemicals used in the pulping process. For example, when the oxidant used is oxygen, the preferred initial pH of the pulp is from about 11 to about 13, and the preferred pH upon conclusion of the bleaching process is from about 11 to about 12.5. For example, when the oxidant used is sodium peroxide or hydrogen peroxide, the preferred initial pH of the pulp is from about 9 to about 11, and the preferred pH upon conclusion of the bleaching process is from about 8.5 to about 10.

Alternatively, bleaching with hydrogen peroxide with a catalyst, a peracid (such as peracetic or persulfuric acid), chlorine or chlorine dioxide, can be performed advantageously when the initial pH of the pulp before chemical application is acidic, such as a pH of from about 2 to about 7, preferably from about 3 to about 6. When the oxidant used is hydrogen peroxide in the presence of a catalyst, the preferred initial pH of the pulp is from about 2.5 to about 3.5, and the preferred pH upon conclusion of the bleaching process in this case is from about 2 to about 3. When the oxidant used is a peracid, the preferred initial pH of the pulp is from about 6 to about 7, and the preferred pH upon conclusion of the bleaching process in this case is from about 4.5 to about 5.5. The preferred pH used when the oxidant is chlorine dioxide varies with the charge of oxidant used. For example, if the charge of chlorine dioxide is about 0.5% by weight of oven dried pulp, then the preferred initial pH of the pulp is from about 6.5 to about 7 and the preferred final pH is from about 5 to about 5.5; if the charge of chlorine dioxide is about 1% by weight of oven dried pulp, then the preferred initial pH of the pulp is from about 5.5 to about 6 and the preferred final pH is from about 3.5 to about 4; and if the charge of chlorine dioxide is about 2% by weight of oven dried pulp, then the preferred initial pH of the pulp is from about 4.5 to about 5 and the preferred final pH is from about 2.5 to about 3.

The duration of the reaction between the pulp and the chemical is another controlling factor in the optimal operation of the chemical pulping system. For example, such duration of the reaction in ozone bleaching is determined by the desired degree of bleaching or brightening required in that particular stage of the pulping process. It is important that the ozone bleaching reaction be accomplished with complete or substantially complete consumption of the ozone, i.e., ozone conversion. The reaction time will vary depending upon factors, such as pressure, the efficiency of mixing the pulp with the ozone, the concentration of the ozone in the ozone gas mixture (with relatively more concentrated ozone mixtures reacting more quickly), the relative direction of the gas and pulp flows (co-current and counter-current), and the desired amount of lignin to be removed.

"Residual chemical," as used herein, shall mean the amount of the at least one chemical that remains unreacted at some time or location after the addition of the at least one chemical.

An important feature of the invention is maintaining a target level of lignin content or standardized brightness value despite varying production rate and operating parameters. This feature is obtained, in part, by monitoring the above controlling factors, among others, to adjust the amount of chemical application for the given operating conditions in order to achieve a target standardized brightness, change in standardized brightness, target lignin content or change in lignin content. As discussed above, it is the nature of the measurement of pulp properties, such that those properties which are true measures of lignin content require longer times to conduct. Generally, with current technology, it takes at least about five minutes to measure such properties, for example, as Kappa number, K number, Klason lignin and the like.

Properties which can be measured quickly or continuously on-line, such as brightness are inconsistent because of fluctuations in the measurement due to many variables such as fiber type, pH, consistency, temperature and the like which affect the measurement but do not reflect changes in lignin content.

Although these fluctuations are generally modest over short periods of time, such as, for example, up to 30 minutes of pulp processing in a bleach plant, they can be much greater over longer periods. Previous attempts to rely on brightness alone to control a fast, short time, bleaching process have failed for this reason.

The present invention overcomes this deficiency by correlating a rapid or continuous measure of pulp property, such as brightness, with a true pulp property measure such as Kappa number, K number, Klason lignin or similar measure of lignin content. It is this correlation, when applied to control the application of chemical to pulp, that is termed "coupled control".

In a production mill setting, this correlation is performed on-line. During the period between successive lignin content measurements, the secondary pulp property, such as brightness, is re-correlated or calibrated periodically with a true measure of lignin content, such as Kappa number, K number, Klason lignin or the like, to control application of the at least one chemical to the pulp.

This technique can be utilized in feedforward, feedback and combination feedforward/feedback control schemes. In addition, measuring other parameters, such as residual chemical, may be used to enhance the coupled control technique.

Lignin Content and Brightness Measurement

Using means well known in the art, the lignin content of the pulp is measured prior to application of the at least one chemical. As an example, Model KNA-5000 sold by the Bonnier Technology Group, which has a relative accuracy of ±2% of the measured value for K numbers between 7.5–75 and a relative accuracy of ±2.5% of the measured value for K numbers between 1.5–7.5, may be used as a sensor for measuring the K number of the pulp before application of the at least one chemical. The lignin content measurements are usually taken periodically about twice every hour at locations before and after the point of application of the at least one chemical. The measurement taken at a location before the point of application of the at least one chemical is identified as $K_{Before}$. The measurement taken at a location after the point of application of the at least one chemical is identified as $K_{After}$. As discussed above, $K_{Before}$ and $K_{After}$ represent any true measure of lignin content, including without limitation permanganate number (also known as K number), Kappa number and Klason lignin number.

With each lignin content measurement, a new brightness measurement is taken of the pulp at a location before and/or after the point of application of the at least one chemical. These brightness measurements are referred to as captured $GEB_{Before}$ and captured $GEB_{After}$.

Where two or more chemicals are applied to the pulp, the phrases "chemical application" and "application of the at least one chemical", as used in this specification, refer to the application of the final chemical.

The lignin content measurements of the pulp at locations after the point of application of the at least one chemical may be made by the sensor discussed above. Typically, the sensor has an accuracy of ±2.5% of the measured value for K numbers less than seven.

It is also advantageous to employ a moving average of three successive lignin content measurements, confounding spurious measurements.

It should be recognized that the minimum resolution time of a completely dedicated K number measuring device is about five minutes and that the residence time of the pulp in a continuous plug flow Z-stage (ozone) reactor is typically less than two minutes. As such, while the K number is being measured, drastic changes might occur to the pulp at locations before the point of application of the at least one chemical.

Figure 2:
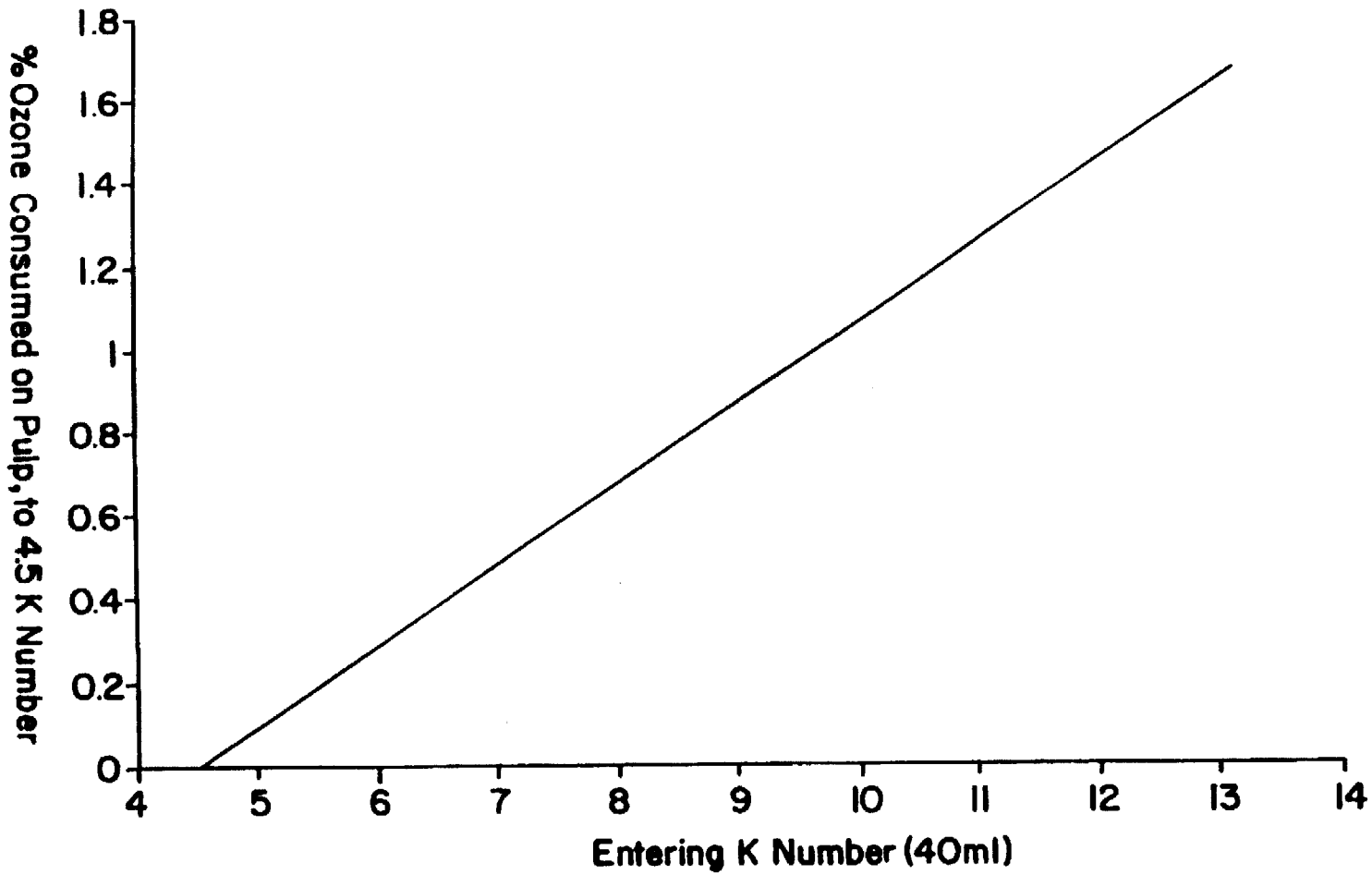
FIG. 2 is a graph of the ozone consumption (%) required to achieve an pulp K number after chemical application of 4.5, versus the pulp K number before chemical application.

FIG. 2 graphically illustrates the relationship between the ozone consumed to reach a specific K number of pulp after ozone application (specifically, of pulp exiting the ozone reactor) and the K number of pulp before ozone application (specifically, of pulp entering the ozone reactor) for a specific set of reactor operating parameters.

Ongoing Brightness Measurement

Another step in the present invention is to measure the ongoing pulp brightness of the pulp between successive lignin content measurements at locations before the point of application of the at least one chemical. As an example, an ozone reactor may utilize an on-line brightness sensor, such as Model BT-5000 sold by the Bonnier Technology Group, to measure the ongoing pulp brightness at a location before the point application of the at least one chemical. In operation, the pulp is exposed to four discrete wavelengths of light and four light detectors gather the scattered light from the pulp and conduct it to a photo-detector. The intensity of the scattered light is proportional to the brightness of the pulp. Typically, the sensor is dedicated to sampling a specific location and, accordingly, continuously samples the brightness of the ongoing pulp with a reproducibility of ±0.5 GEB units.

The brightness measurements continue to be made during the interval between successive lignin content measurements. In this way, the amount of feed chemical is established through accurate and aggressive feedforward action based on the lignin content and brightness measurements taken at locations before the point of application of the at least one chemical, and the soft feedback action based on the lignin content and brightness measurements taken at locations after the point of application of the at least one chemical.

The coupled control system is thus able to anticipate the change in the lignin content of the pulp at locations before the point of application of the at least one chemical, and adjust the quantity of the at least one chemical accordingly.

In a preferred embodiment, the control system does not take immediate action upon measuring a small change in pulp brightness, but rather uses a moving average of the pulp brightness to initiate a change in the quantity of the at least one chemical. Thus, the control system is shown to respond to quick but real changes in pulp property at locations before the point of application of the at least one chemical, which is especially important for quick-reacting systems. The brightness measurements continue to be made between successive lignin content measurements. They may be done periodically or continuously. Preferred measuring times may be from about a second to about 10 minute intervals with times of about 3 seconds to about 5 minutes being most preferred.

Coupled Process Control Strategy

The general strategy for controlling the degree of delignification or bleaching is to dynamically control the amount of the at one least chemical application. Preferably, a process control strategy is based on feedforward control along with feedback control. Under feedforward control, the amount of the at least one chemical at a location before the point of application is appropriately adjusted to match the calculated chemical application derived from the relationship set forth in the following equation to achieve the desired degree of delignification or bleaching.

The measured lignin content of pulp at a location before the point of chemical application is $K_{Before}$, the measured lignin content of pulp at a location after the point of chemical application is $K_{After}$, and the desired or expected degree of delignification or bleaching at a location after the point of chemical application is target $K_{After}$. Upon taking successive lignin content measurements of pulp at locations before the point of chemical application, $K_{Before}$ is compared with a desired or an expected lignin content of pulp at a location before the point of chemical application, i.e., target $K_{Before}$. If the $K_{Before}$ matches the target $K_{Before}$, a specific amount of chemical is applied to the pulp. This amount of chemical ($C_1$) is the amount of chemical that is projected as required to reach the target $K_{After}$, i.e., the desired degree of delignification or bleaching at a location after the point of chemical application. If the $K_{Before}$ and target $K_{Before}$ are different, the amount of chemical applied is modified accordingly ($C_2(K_{Before}$-[target $K_{Before}$])).

The "$GEB_{Before}$" and "$GEB_{After}$" are the pulp brightness values measured between consecutive lignin content measurements at locations before and after the point of chemical application, respectively. With each lignin content measurement, a new brightness measurement is taken of the pulp at a location before and/or after the point of chemical application. These brightness measurements are referred to as "captured $GEB_{Before}$" and "captured $GEB_{After}$". The $GEB_{Before}$ is compared with the captured $GEB_{Before}$ and their difference is used to modify the amount of applied chemical in the feedforward portion of the control strategy. Similarly, the $GEB_{After}$ is compared with the captured $GEB_{After}$ and their difference is used to modify the applied chemical in the feedback portion of the control strategy.

Calculating the chemical application required to reach a desired degree of delignification or bleaching comprises the formula:

$$\begin{aligned}\text{Chemical}_{app} = \; & C_1 + C_2(|K_{Before}| - |\text{target } K_{Before}|) + \\ & C_3(|\text{captured } GEB_{Before}| - |GEB_{Before}|) + \\ & C_4(|K_{After}| - |\text{target } K_{After}|) + C_5(|\text{captured} \\ & GEB_{After}| - |GEB_{After}|) + C_6(|\text{target } GEB_{After}| - \\ & |\text{captured } GEB_{After}|) + C_7(|\text{target } GEB_{After}| - \\ & |GEB_{After}|)\end{aligned}$$

wherein $\text{Chemical}_{app}$ is the calculated chemical application necessary to achieve the desired degree of delignification or bleaching, and $C_1$ through $C_7$ are constants. Those skilled in the art will readily note that constants $C_1$ through $C_7$ will vary with different reactors and pulps, and can be easily determined by routine testing and collection of data for the particular reactor and pulp that are selected.

The feedback control strategy includes assessing the current status of a pulp property at locations after the point of chemical application, and measuring the difference between this measured value and the desired or expected (target) value of that pulp property. Once the difference between the target pulp property and the pulp property after chemical application has been determined and compared to the ongoing brightness measurements, the chemical application (more exactly, the chemical flow rate at a fixed chemical concentration) is, accordingly, increased or decreased until the target pulp property level is detected by on-line sensors at locations after the point of chemical application.

The $K_{After}$ and $GEB_{After}$ are measured when the pulp has reached about 50%, preferably 70%, and most preferably 80%, of the desired degree of delignification or brightness.

Alternatively, $K_{After}$ and $GEB_{After}$ are measured about 20 minutes, preferably 10 minutes, and most preferably 5 minutes, after application of the at least one chemical (or after application of the final chemical where two or more chemicals are applied).

In a preferred embodiment, the control method utilizes only feedforward control and the chemical application required to bleach the pulp is calculated from the formula:

$$\text{Chemical}_{app}=C_1+C_2([K_{Before}]-[\text{target } K_{Before}])+C_3([\text{captured } GEB_{Before}]-[GEB_{Before}]).$$

In another preferred embodiment, the control method utilizes feedforward control and some feedback control near the end of the pulping process, and the chemical application required to bleach the pulp is calculated from the formula:

$$\text{Chemical}_{app}=C_1+C_2([K_{Before}]-[\text{target } K_{Before}])+C_3([\text{captured } GEB_{Before}]-[GEB_{Before}])+C_7([\text{target } GEB_{After}]-[GEB_{After}]).$$

The various control functions and calculations are implemented by function blocks configured from control diagrams developed by SAMA Standards, which are well known in the art. Typically, the control system hardware utilized is implemented by distributed microprocessors, each of which is dedicated to performing a specific function. The processing elements are linked to one another to form an integrated process control system, typically with a highly parallel distributed architecture. As these devices are all well known in the art, they are not discussed in this specification.

EXAMPLES

The following examples are illustrative of the present invention and are not intended to be limitations thereon. All percentages are based on 100% by weight of oven dried pulp.

EXAMPLE 1

Inventive Runs A to F

Figures 3A, 3B, 3C:
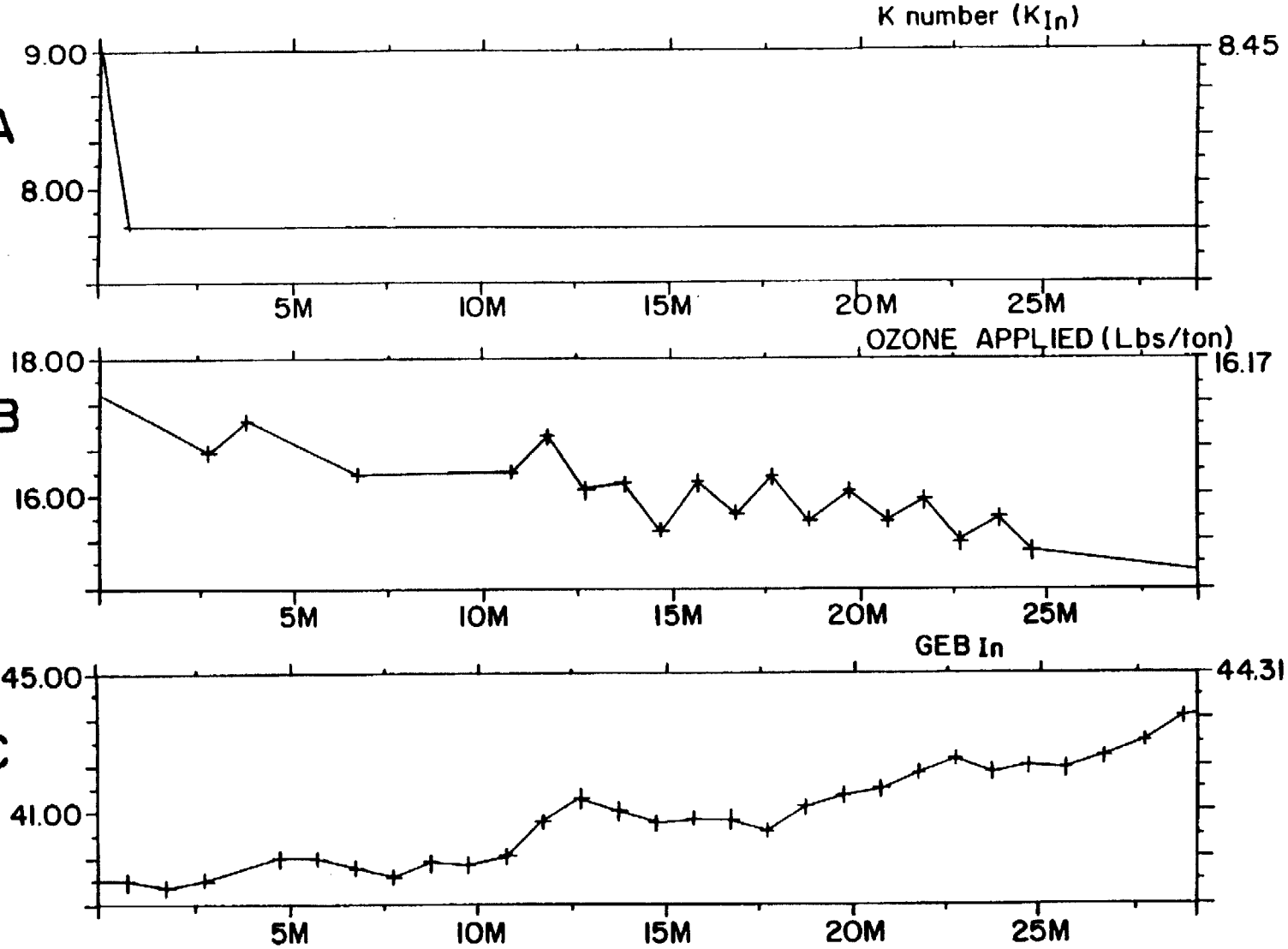
FIGS. 3*a*, 4*a*, 5*a* and 6*a* are graphs of the K numbers of pulp before chemical application, versus time.
FIGS. 3*b*, 4*b*, 5*b* and 6*b* are graphs of the applied ozone versus time.
FIGS. 3*c*, 4*c*, 5*c* and 6*c* are graphs of the brightness of pulp before chemical application, versus time.
Figure 4A:
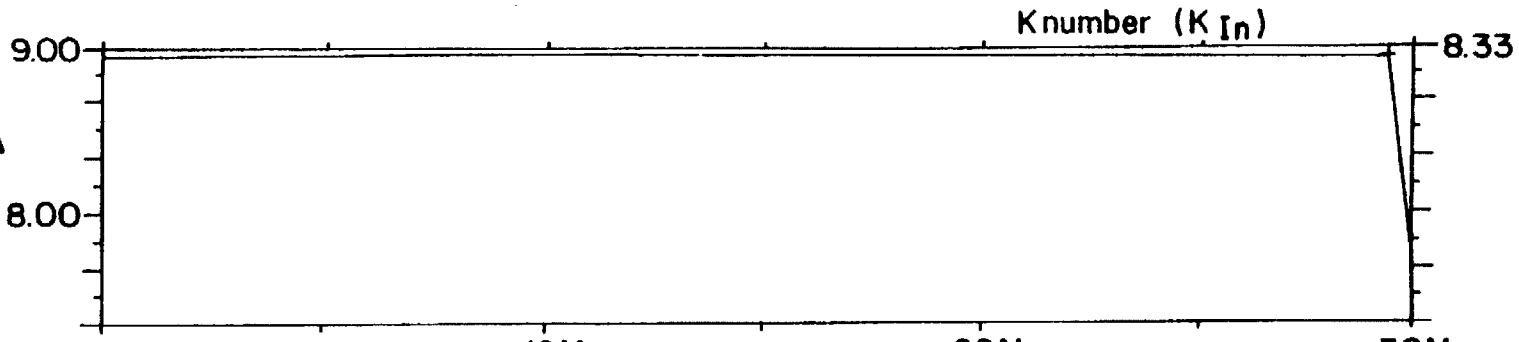
Figure 4B:
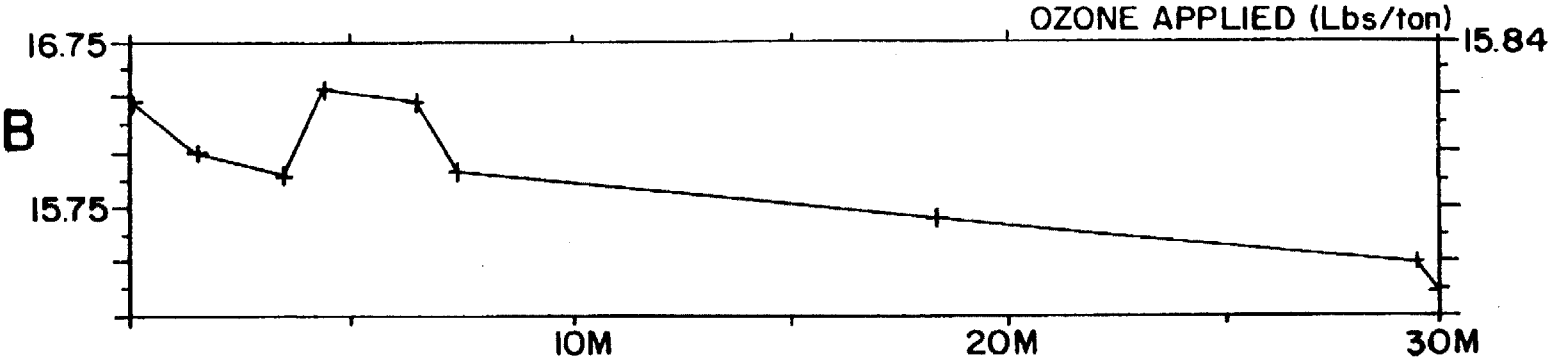
Figure 4C:
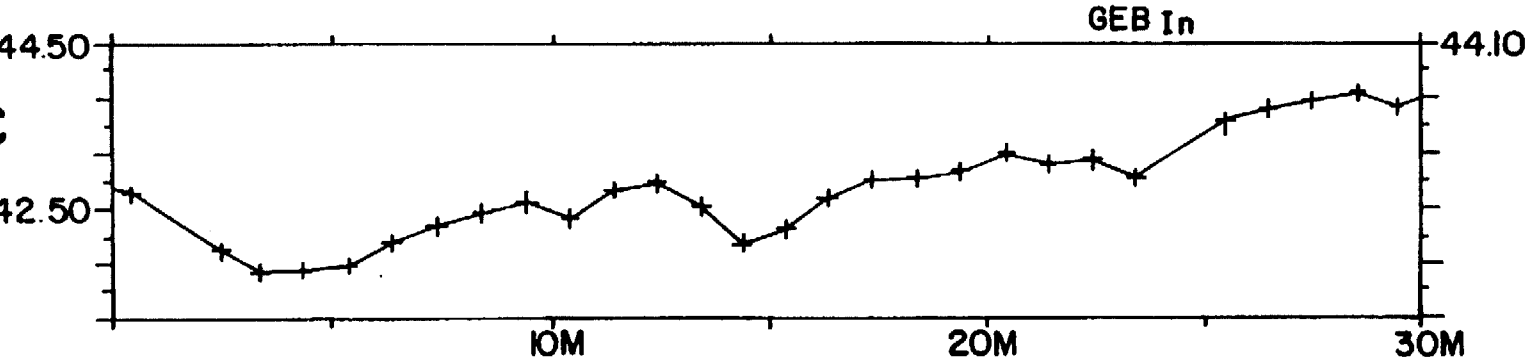

FIGS. 3*a*, 3*b*, 3*c*, 4*a*, 4*b* and 4*c* show three process variables (on-line) as they change during ozone bleaching; each variable is depicted separately. FIGS. 3*a* and 4*a* show the post oxygen stage K number—a measure of the lignin content of the pulp after oxygen application. In both cases, the K number did not change for nearly 30 minutes, which is the typical time between consecutive measurements of K number of the pulp before oxygen application (specifically, of pulp entering the plug flow ozonation reactor). In the graphs, the crosses denote actual measurements and the lines simply connect the measured values which are plotted at specific intervals. The minimum resolution-time of a completely dedicated K number measuring device is about five minutes and the residence time of the pulp in the ozone reactor is typically less than two minutes. FIGS. 3*b* and 4*b* show the ozone application to the reactor, while FIGS. 3*c* and 4*c* show the brightness of pre-ozone stage-pulp. Between successive K number measurements, changes took place in the pre-ozone-stage pulp (entering the Z-stage) which were recorded as changes in the pulp brightness. The control system used this information to anticipate the eventual change in the lignin content of the post-stage pulp and forced changes in the applied ozone charge (expressed as pounds per ton, PPT).

EXAMPLE 2

Inventive Runs G to N

Figure 5A:
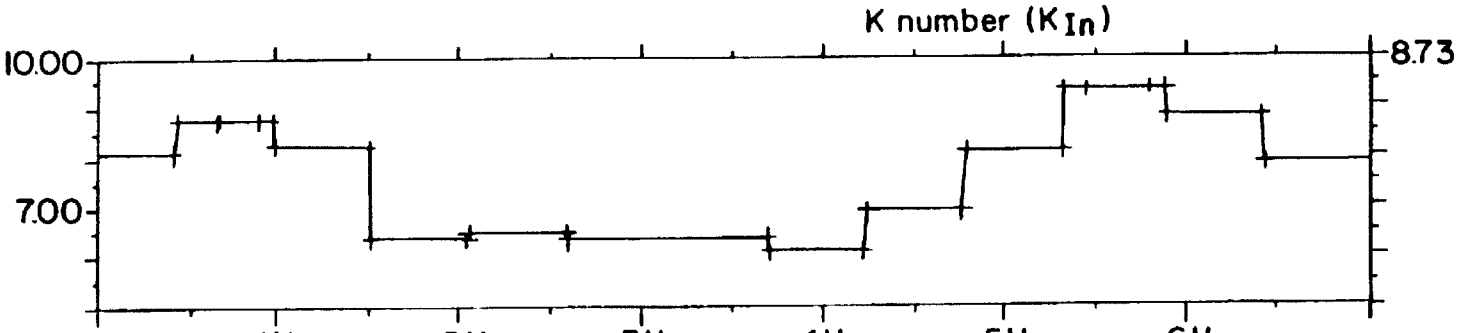
Figure 5B:
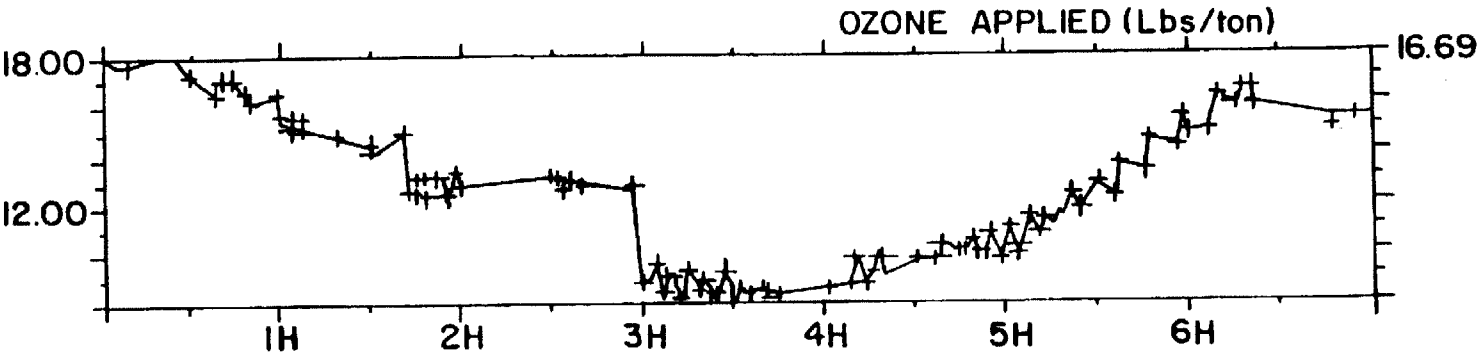
Figure 5C:
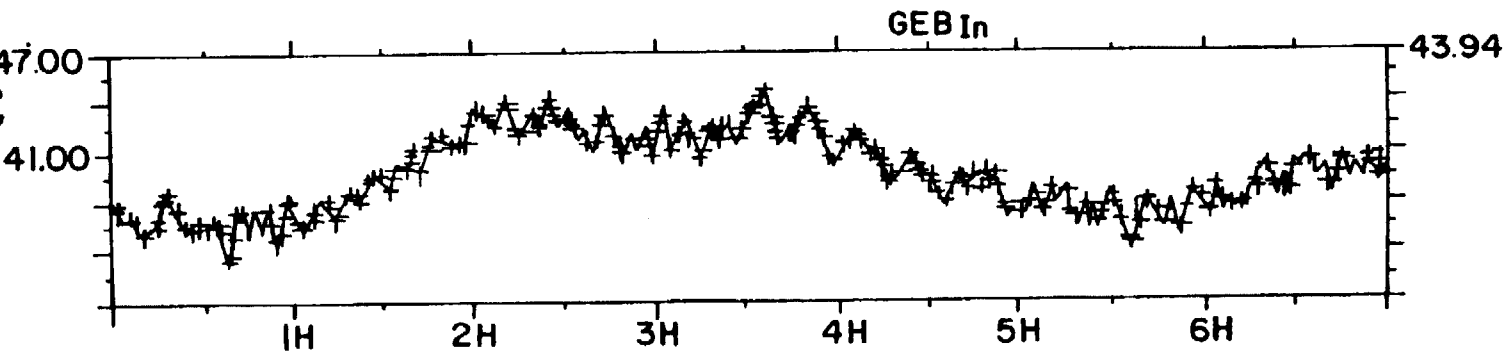
Figure 6A:
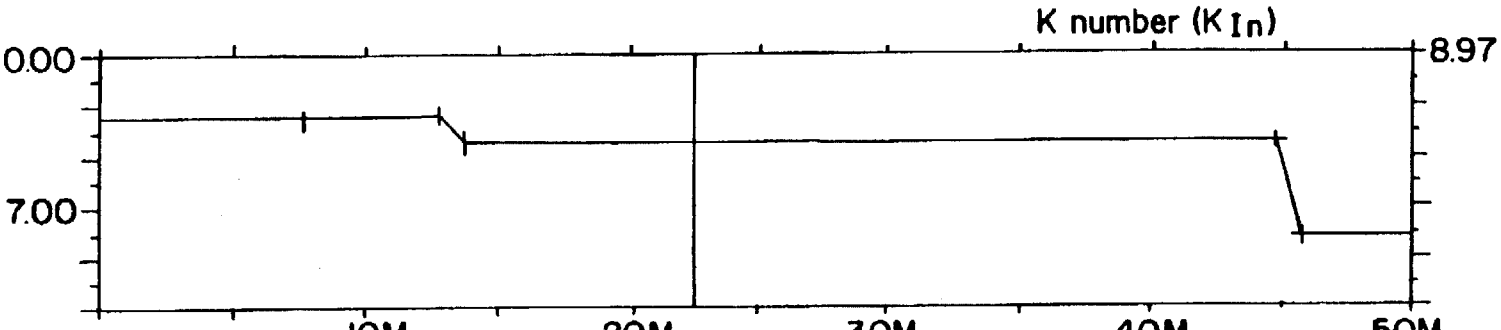
Figure 6B:
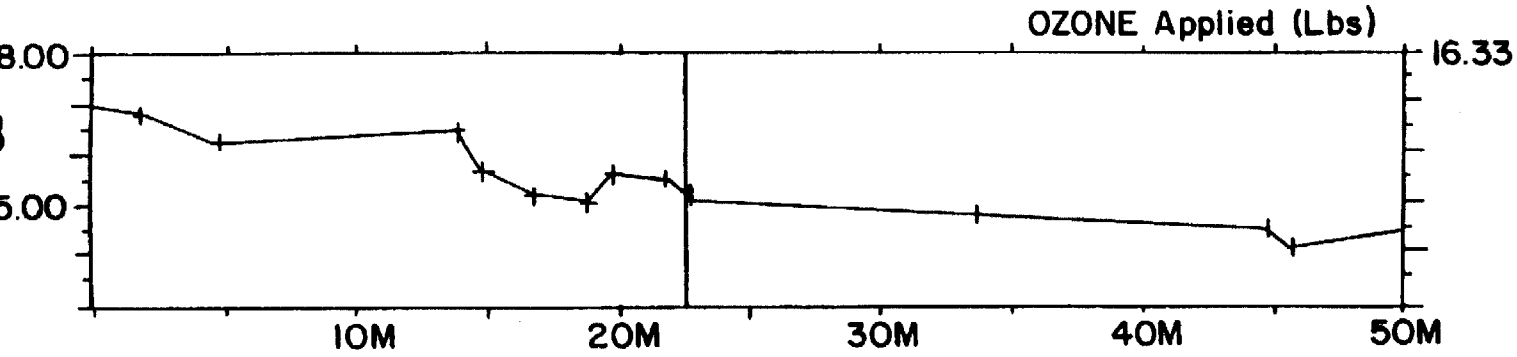
Figure 6C:
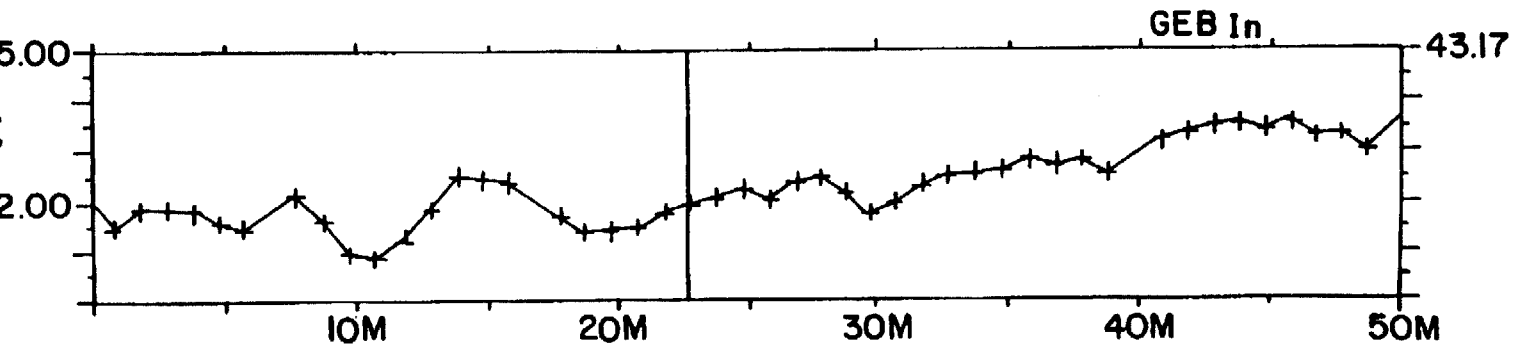

FIGS. 5*a*, 5*b* and 5*c* show the progress of an ozone bleaching process using a plug flow reactor over a 7 hour period, while FIGS. 6*a*, 6*b* and 6*c* show the progress of operations over a 50 minute period that same day. Three process variables (on-line) are shown—each in a separate figure. FIGS. 5a and 6a show the post-oxygen-stage K number—a measure of the lignin content of the pulp after oxygen application. In the figures, the crosses denote actual measurements and the lines simply connect the measured values which are plotted at specific intervals. The post oxygen stage K number is measured at about 25 minute intervals. The minimum resolution-time of a completely dedicated K number measuring device is about five minutes and that the residence time of the pulp in the ozone reactor is typically less than two minutes.

FIGS. 5b and 6b show the ozone application to a reactor, while FIGS. 5c and 6c show the brightness of the pre ozonation-stage pulp.

Between successive K number measurements, changes took place in the post oxygen or pre ozone stage pulp, which were recorded as changes in the pulp brightness. The control system used this information to anticipate the eventual change in the K number (measured 25 minutes later) of the pre-ozonation-stage pulp and forced changes in the applied ozone charge (expressed as pounds per ton, PPT).

The control system does not take immediate action upon measuring a small change in brightness, but rather uses a moving average of the pulp brightness to initiate a change in the applied ozone. Similarly, the control system employs a moving average of three K number measurements, confounding spurious measurements. The control system is shown to respond to quick but real changes in incoming pulp quality, which is especially important for quick-reacting systems. The pulp tonnage during the 50 minute period in FIG. 6 was relatively stable.

Figure 7A:
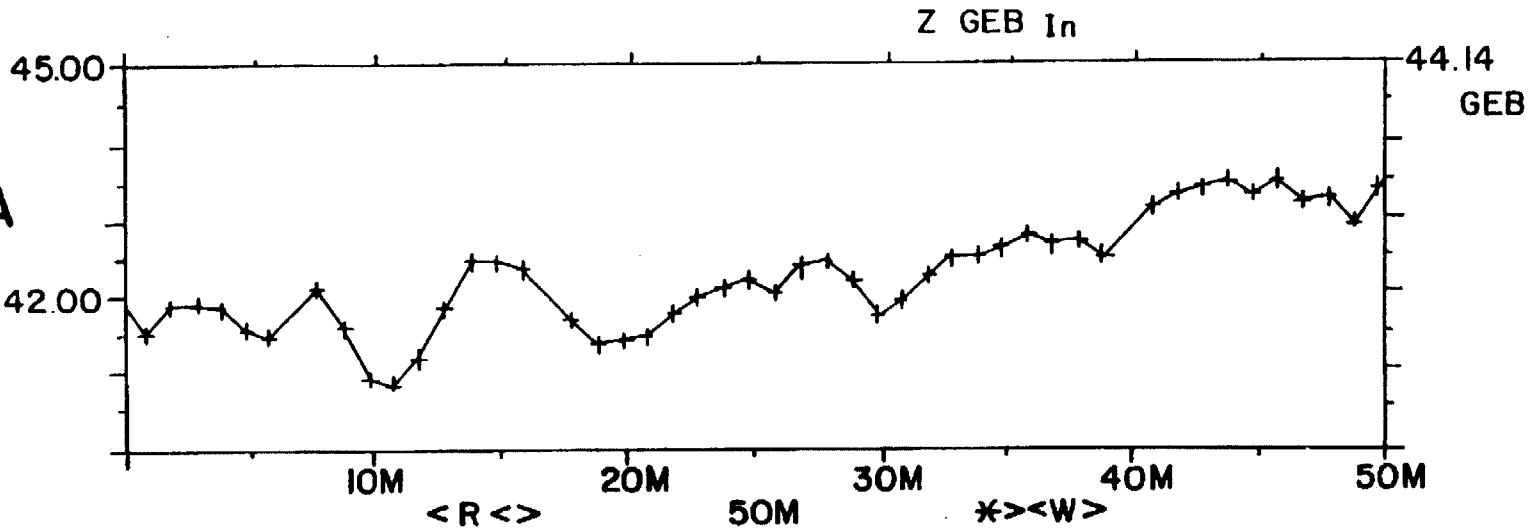
FIGS. 7*a* and *b* are graphs of the brightness levels of pulp after chemical application, versus time.
Figure 7B:
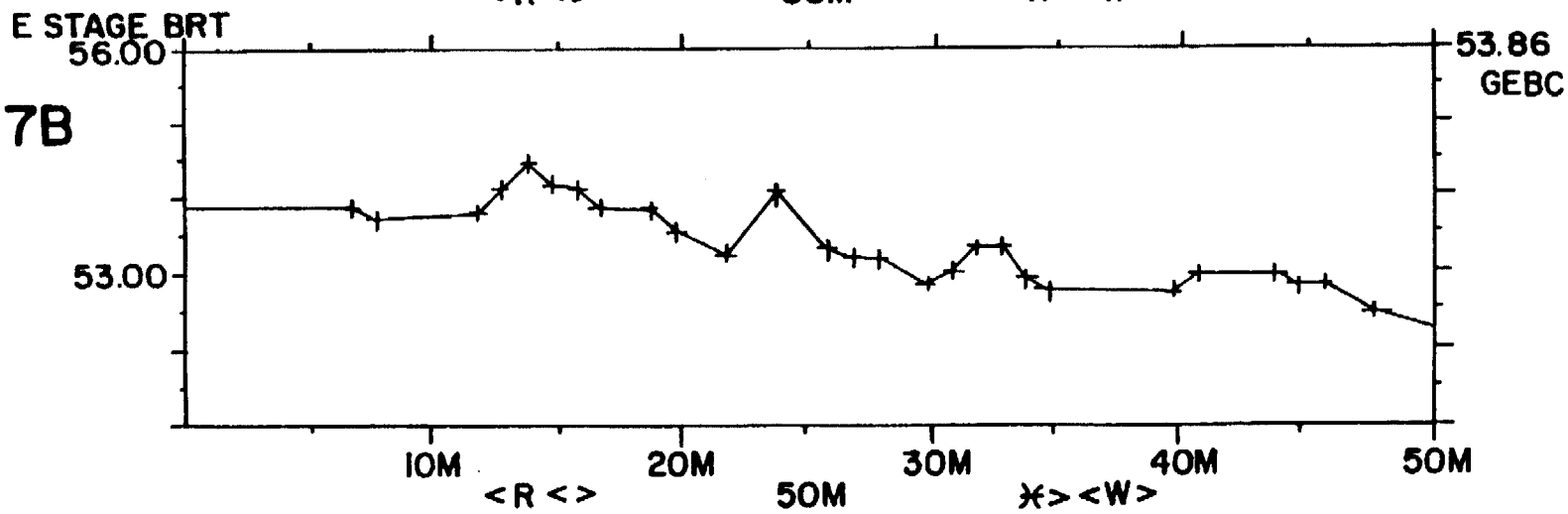

FIG. 7 is an attempt to depict the stabilizing effect of the control system on the brightness of pulp after ozone application (specifically, of pulp exiting the ozone reactor). The on-line measurement shown in FIG. 7a is the brightness entering the Z stage of F-line's OZEoD sequence. The on-line measurement shown in FIG. 7b is the brightness exiting the Eo stage of F-line's OZEoD sequence. The Eo brightness was time-shifted 80 minutes, in accordance with estimates of the residence time in the Z and Eo stages. The variation in the brightness of the ozonation-stage pulp was decreased.

The invention being thus described, it will be obvious that the same may be varied in many ways. Such variations are not to be regarded as a departure from the spirit and scope of the invention and all such modifications are intended to be included within the scope of the following claims.

We claim:

1. A coupled control method for controlling a chemical pulping process to obtain a desired degree of delignification or bleaching, which comprises:

(a) adding at least one chemical at a desired amount to pulp;

(b) passing the pulp into and out of a reactor;

(c) measuring the brightness value of the pulp between successive lignin content measurements; and (d) adjusting the quantity of the at least one chemical required to reach a desired degree of delignification or bleaching in response to the measured brightness and lignin content values.

2. The method of claim 1, wherein the chemical pulping process is continuous, batch, semibatch or a combination thereof.

3. The method of claim 1, wherein the at least one chemical is selected from the group consisting of an oxidant, a caustic, a chelating agent, an oxidant stabilizer, a catalyst and a combination thereof.

4. The method of claim 3, wherein:

the oxidant is selected from the group consisting of hydrogen peroxide, oxygen, ozone, chlorine, chlorine dioxide, peracetic acid, persulfuric acid, and a combination thereof;

the caustic is selected from the group consisting of sodium hydroxide, potassium hydroxide, and a carbonate salt;

the chelating agent is selected from the group consisting of diethylenetriaminepentaacetic acid (DTPA), ethylenediaminetetraacetic acid (EDTA), nitrilotriacetic acid (NTA), methanediphosphonic acid (MDPA), tetrahydrofurantetracarboxylic acid (THFTCA), (1-hydroxyethylidene) diphosphonic acid (HEDPA), sodium silicate, a derivative thereof, and a combination thereof;

the oxidant stabilizer is selected from the group consisting of magnesium sulfate, sodium silicate and a combination thereof; and the catalyst is a metal based activator containing at least one metal selected from the group consisting of chromium, vanadium, molybdenum, titanium, tungsten, tin, osmium, and selenium.

5. The method of claim 1, wherein the brightness values are measured periodically between successive lignin content measurements.

6. The method of claim 1, wherein the brightness values are measured continuously between successive lignin content measurements.

7. The method of claim 1, wherein the adjusting step comprises:

(a) periodically measuring the lignin content of the pulp at a location before the point of application of the at least one chemical, or before the point of application of the final chemical where two or more chemicals are applied, and adjusting the amount of the at least one chemical to obtain the desired degree of delignification or bleaching;

(b) measuring the pulp brightness between periodic lignin content measurements, and optionally making an average of several pulp brightness measurements;

(c) comparing the brightness measurement or the average brightness measurement with the brightness representing the lignin content for that period prior to the next lignin content measurement to initiate an adjustment in the quantity of the at least one chemical; and (d) adjusting the quantity of the at least one chemical in response to the comparison value.

8. The method of claim 7, wherein step (b) is repeated periodically.

9. The method of claim 7, wherein step (b) is repeated continuously.

10. The method of claim 7, wherein the pulp brightness is measured about every second to about ten minutes between lignin content measurements.

11. The method of claim 7, wherein the chemical application required to delignify or bleach the pulp is calculated from the formula:

$$\text{Chemical}_{app} = C_1 + C_2([K_{Before}] - [\text{target } K_{Before}]) + C_3([\text{captured } GEB_{Before}] - [GEB_{Before}]) + C_4([K_{After}] - [\text{target } K_{After}]) + C_5([\text{captured } GEB_{After}] - [GEB_{After}]) + C_6([\text{target } GEB_{After}] - [\text{captured } GEB_{After}]) + C_7([\text{target } GEB_{After}] - [GEB_{After}])$$

wherein:

$\text{Chemical}_{app}$ is the calculated chemical application necessary to achieve the desired degree of delignification or bleaching;

$K_{Before}$ is the pulp lignin content measured at a location before the point of application of the at least one chemical, or before the point of application of the final chemical where two or more chemicals are applied;

$K_{After}$ is the pulp lignin content measured at a location after the point of application of the at least one chemical, or after the point of application of the final chemical where two or more chemicals are applied;

target $K_{Before}$ is a desired, or an expected, pulp lignin content at a location before the point of application of the at least one chemical, or before the point of application of the final chemical where two or more chemicals are applied;

target $K_{After}$ is a desired, or an expected, lignin content at a location after the point of application of the at least one chemical, or after the point of application of the final chemical where two or more chemicals are applied;

$GEB_{Before}$ is the pulp brightness measured at a location before the point of application of the at least one chemical, or before the point of application of the final chemical where two or more chemicals are applied;

$GEB_{After}$ is the pulp brightness measured at a location after the point of application of the at least one chemical, or after the point of application of the final chemical where two or more chemicals are applied;

captured $GEB_{Before}$ is the pulp brightness measured at the time of the $K_{After}$ measurement;

captured $GEB_{After}$ is the pulp brightness measured at the time of the $K_{After}$ measurement;

target $GEB_{After}$ is a desired, or an expected, pulp brightness at a location after the point of application of the at least one chemical, or after the point of application of the final chemical where two or more chemicals are applied; and $C_1$ through $C_7$ are constants.

12. The method of claim 11, wherein the method utilizes only feedforward control and the chemical application required to bleach the pulp is calculated from the formula:

$$\text{Chemical}_{app}=C_1+C_2([K_{Before}]-[\text{target } K_{Before}])+C_3([\text{captured } GEB_{Before}]-[GEB_{Before}]).$$

13. The method of claim 11, wherein the method utilizes feedforward control and some feedback control and the chemical application required to bleach the pulp is calculated from the formula:

$$\text{Chemical}_{app} = C_1 + C_2([K_{Before}] - [\text{target } K_{Before}]) + C_3([\text{captured } GEB_{Before}] - [GEB_{Before}]) + C_7([\text{target } GEB_{After}] - [GEB_{After}]).$$

14. The method of claim 11, wherein $K_{After}$ and $GEB_{After}$ are measured when the pulp has reached about 50% of the desired degree of delignification or brightness.

15. The method of claim 11, wherein $K_{After}$ and $GEB_{After}$ are measured when the pulp has reached about 70% of the desired degree of delignification or brightness.

16. The method of claim 11, wherein $K_{After}$ and $GEB_{After}$ are measured when the pulp has reached about 80% of the desired degree of delignification or brightness.

17. The method of claim 11, wherein $K_{After}$ and $GEB_{After}$ are measured about 20 minutes after application of the at least one chemical, or after application of the final chemical where two or more chemicals are applied.

18. The method of claim 11, wherein $K_{After}$ and $GEB_{After}$ are measured about 10 minutes after application of the at least one chemical, or after application of the final chemical where two or more chemicals are applied.

19. The method of claim 11, wherein $K_{After}$ and $GEB_{After}$ are measured about 5 minutes after application of the at least one chemical, or after application of the final chemical where two or more chemicals are applied.

20. The method of claim 7, wherein the amount of the at least one chemical is further adjusted by correcting for the pH, temperature, flow rate or consistency of the pulp at a location before the point of application of the at least one chemical, or before the point of application of the final chemical where two or more chemicals are applied, the flow rate or concentration of the at least one chemical, the residence time of the pulp in the reactor, the pressure, the efficiency of mixing, the residual chemical, or a combination thereof.

21. The method of claim 1, wherein the brightness values of multiple measurements are averaged together to derive a brightness value which is used to initiate an adjustment in the quantity of the at least one chemical.

22. The method of claim 1, wherein the quantity of the at least one chemical is adjusted by a moving average of at least three lignin content measurements.

23. A coupled control method for controlling a chemical pulping process to obtain a desired degree of delignification or bleaching, which comprises:

(a) adding at least one chemical at a desired amount to pulp;

(b) passing the pulp into and out of a reactor;

(c) measuring the brightness value of the pulp between successive lignin content measurements; and (d) adjusting the quantity of the at least one chemical required to reach a desired degree of delignification or bleaching in response to the measured brightness and lignin content values;

the adjusting step comprises:

(e) periodically measuring the lignin content of the pulp at a location before the point of application of the at least one chemical, or before the point of application of the final chemical where two or more chemicals are applied, and adjusting the amount of the at least one chemical to obtain the desired degree of delignification or bleaching;

(f) measuring the pulp brightness between periodic lignin content measurements, and optionally making an average of several pulp brightness measurements;

(g) comparing the brightness measurement or the average brightness measurement with the brightness representing the lignin content for that period prior to the next lignin content measurement to initiate an adjustment in the quantity of the at least one chemical; and (h) adjusting the quantity of the at least one chemical in response to the comparison value.

24. The method of claim 23, wherein the chemical pulping process is continuous, batch, semibatch or a combination thereof.

25. The method of claim 23, wherein the at least one chemical is selected from the group consisting of an oxidant, a caustic, a chelating agent, an oxidant stabilizer, a catalyst and a combination thereof.

26. The method of claim 25, wherein:

the oxidant is selected from the group consisting of hydrogen peroxide, oxygen, ozone, chlorine, chlorine dioxide, peracetic acid, persulfuric acid, and a combination thereof;

the caustic is selected from the group consisting of sodium hydroxide, potassium hydroxide, and a carbonate salt;

the chelating agent is selected from the group consisting of diethylenetriaminepentaacetic acid (DTPA), ethylenediaminetetraacetic acid (EDTA), nitrilotriacetic acid (NTA), methanediphosphonic acid (MDPA), tetrahydrofurantetracarboxylic acid (THFTCA), (1-hydroxyethylidene) diphosphonic acid (HEDPA), sodium silicate, a derivative thereof, and a combination thereof;

the oxidant stabilizer is selected from the group consisting of magnesium sulfate, sodium silicate and a combination thereof; and the catalyst is a metal based activator containing at least one metal selected from the group consisting of chromium, vanadium, molybdenum, titanium, tungsten, tin, osmium, and selenium.

27. The method of claim 23, wherein the chemical application required to delignify or bleach the pulp is calculated from the formula:

$$\begin{aligned}\text{Chemical}_{app} = \; & C_1 + C_2([K_{Before}] - [\text{target } K_{Before}]) + \\ & C_3([\text{captured } GEB_{Before}] - [GEB_{Before}]) + \\ & C_4([K_{After}] - [\text{target } K_{After}]) + C_5([\text{captured } GEB_{After}] - [GEB_{After}]) + C_6([\text{target } GEB_{After}] - [\text{captured } GEB_{After}]) + C_7([\text{target } GEB_{After}] - [GEB_{After}])\end{aligned}$$

wherein:

$\text{Chemical}_{app}$ is the calculated chemical application necessary to achieve the desired degree of delignification or bleaching;

$K_{Before}$ is the pulp lignin content measured at a location before the point of application of the at least one chemical, or before the point of application of the final chemical where two or more chemicals are applied;

$K_{After}$ is the pulp lignin content measured at a location after the point of application of the at least one chemical, or after the point of application of the final chemical where two or more chemicals are applied;

target $K_{Before}$ is a desired, or an expected, pulp lignin content at a location before the point of application of the at least one chemical, or before the point of application of the final chemical where two or more chemicals are applied;

target $K_{After}$ is a desired, or an expected, pulp lignin content at a location after the point of application of the at least one chemical, or after the point of application of the final chemical where two or more chemicals are applied;

$GEB_{Before}$ is the pulp brightness measured at a location before the point of application of the at least one chemical, or before the point of application of the final chemical where two or more chemicals are applied;

$GEB_{After}$ is the pulp brightness measured at a location after the point of application of the at least one chemical, or after the point of application of the final chemical where two or more chemicals are applied;

captured $GEB_{Before}$ is the pulp brightness measured at the time of the $K_{Before}$ measurement;

captured $GEB_{After}$ is the pulp brightness measured at the time of the $K_{After}$ measurement;

target $GEB_{After}$ is a desired, or an expected, pulp brightness at a location after the point of application of the at least one chemical, or after the point of application of the final chemical where two or more chemicals are applied; and $C_1$ through $C_7$ are constants.

28. The method of claim 27, wherein the method utilizes only feedforward control and the chemical application required to bleach the pulp is calculated from the formula:

$$\text{Chemical}_{app}=C_1+C_2([K_{Before}]-[\text{target } K_{Before}])+C_3([\text{captured } GEB_{Before}]-[GEB_{Before}]).$$

29. The method of claim 27, wherein the method utilizes feedforward control and some feedback control and the chemical application required to bleach the pulp is calculated from the formula:

$$\begin{aligned}\text{Chemical}_{app} = \; & C_1 + C_2([K_{Before}] - [\text{target } K_{Before}]) + \\ & C_3([\text{captured } GEB_{Before}] - [GEB_{Before}]) + \\ & C_7([\text{target } GEB_{After}] - [GEB_{After}]).\end{aligned}$$

30. The method of claim 27, wherein $K_{After}$ and $GEB_{After}$ are measured when the pulp has reached about 50% of the desired degree of delignification or brightness.

31. The method of claim 27, wherein $K_{After}$ and $GEB_{After}$ are measured when the pulp has reached about 70% of the desired degree of delignification or brightness.

32. The method of claim 27, wherein $K_{After}$ and $GEB_{After}$ are measured when the pulp has reached about 80% of the desired degree of delignification or brightness.

33. The method of claim 27, wherein $K_{After}$ and $GEB_{After}$ are measured about 20 minutes after application of the at least one chemical, or after application of the final chemical where two or more chemicals are applied.

34. The method of claim 27, wherein $K_{After}$ and $GEB_{After}$ are measured about 10 minutes after application of the at least one chemical, or after application of the final chemical where two or more chemicals are applied.

35. The method of claim 27, wherein $K_{After}$ and $GEB_{After}$ are measured about 5 minutes after application of the at least one chemical, or after application of the final chemical where two or more chemicals are applied.

36. The method of claim 23, wherein the amount of the at least one chemical is further adjusted by correcting for the pH, temperature, flow rate or consistency of the pulp at a location before the point of application of the at least one chemical, or before the point of application of the final chemical where two or more chemicals are applied, the flow rate or concentration of the at least one chemical, the residence time of the pulp in the reactor, the pressure, the efficiency of mixing, the residual chemical, or a combination thereof.

* * * * *